US008444047B2

(12) United States Patent
Edvardsson

(10) Patent No.: US 8,444,047 B2
(45) Date of Patent: May 21, 2013

(54) MUG

(75) Inventor: Anders Edvardsson, Bandhagen (SE)

(73) Assignee: SkyltAnders AB, Bandhagen (SE)

( * ) Notice: Subject to any disclaimer, the term of this patent is extended or adjusted under 35 U.S.C. 154(b) by 325 days.

(21) Appl. No.: 12/881,599

(22) Filed: Sep. 14, 2010

(65) Prior Publication Data

US 2011/0062225 A1 Mar. 17, 2011

(30) Foreign Application Priority Data

Sep. 15, 2009 (SE) ..... 0901185

(51) Int. Cl.
*B65D 3/28* (2006.01)
*B01F 13/00* (2006.01)

(52) U.S. Cl.
USPC ..... 229/400; 366/130; 366/341

(58) Field of Classification Search ... 229/400; 206/217, 206/219; 214/DIG. 8; 366/130, 341, 349, 366/608
See application file for complete search history.

(56) References Cited

U.S. PATENT DOCUMENTS

| | | | | | |
|---|---|---|---|---|---|
| 1,134,354 | A | * | 4/1915 | Seifke | 366/130 |
| 2,965,274 | A | * | 12/1960 | Brillis et al. | 229/400 |
| 3,138,371 | A | * | 6/1964 | Feher et al. | 366/341 |
| 3,341,184 | A | | 9/1967 | Merrill | |
| 3,397,867 | A | * | 8/1968 | Van'T Hof | 366/341 |
| 3,400,855 | A | * | 9/1968 | Alexander | 229/402 |
| 3,606,262 | A | * | 9/1971 | Palmer | 366/341 |
| 3,920,226 | A | * | 11/1975 | Walt | 366/130 |
| 4,253,772 | A | * | 3/1981 | Burton-Smith | 366/130 |
| 5,477,978 | A | * | 12/1995 | Lo | 229/400 |
| 7,717,610 | B2 | * | 5/2010 | Schlebach | 366/130 |

* cited by examiner

*Primary Examiner* — Gary Elkins
(74) *Attorney, Agent, or Firm* — Young & Thompson

(57) ABSTRACT

The present invention relates to a mug, especially a disposable mug, which mug defines an internal space for receiving liquid. It is significant for the mug according to the present invention that the mug contains a flap (10; 110) provided on the inside of the mug, that the flap (10; 110) extends along the inside of the mug in a non-active state, and that the flap (10; 110) reaches out from the inside of the mug in an active state of the flap (10; 110).

8 Claims, 2 Drawing Sheets

MUG

THE TECHNICAL FIELD OF THE INVENTION

The present invention relates to a mug, preferably a disposable mug, where the mug defines an internal space for receiving liquid.

THE STATE OF THE ART

From U.S. Pat. No. 3,341,184 a container or similar with internal fins is known, said fins protruding radially inwards from the wall of the container. A fin is also arranged in the bottom of the container. The fins can be mould in the container.

OBJECTS AND FEATURES OF THE INVENTION

A primary object of the present invention is to present a disposable mug, designed to make possible the mixing of liquids contained in the mug, without the use of external means.

A further object of the invention is that the mixing function of the mug is activated when liquid is supplied to the mug.

A further object of the present invention is that the mug shall be stackable.

Still a further object of the present invention is that the manufacturing cost shall be only marginally higher than for a conventional disposable mug.

At least the primary object of the present invention is realized by means of a design that has been given the characterizing features described in the adherent independent claim 1. Preferred embodiments of the invention are defined in the dependent claims.

BRIEF DESCRIPTION OF THE DRAWINGS

Below a preferred embodiment of the invention will be described, reference being made to the attached drawings, where.

DETAILED DESCRIPTION OF A PREFERRED EMBODIMENT OF THE INVENTION

Figure 1:
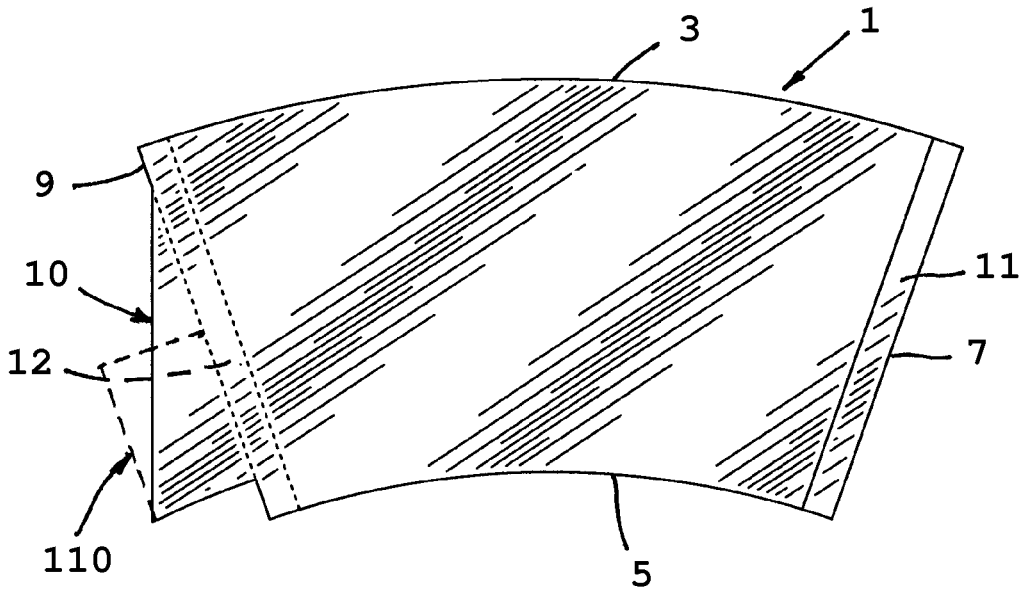
FIG. 1 shows a top view of a preferred embodiment of a blank for a mug according to the present invention.

The blank shown in FIG. 1 for a mug according to the present invention is generally shaped as a spread out truncated cone, where the blank 1 comprises a first curved edge portion 3, a second curved edge portion 5, a first rectilinear, lateral edge portion 7 and a second lateral edge portion 9 including a flap 10 in the shape of a triangular portion. Each one of the lateral edge portions 7, 9 extends between the curved edge portions 3, 5. The blank 1 is preferably manufactured from a cellulose-based material, normally board.

In the disclosed embodiment, the curved edge portions 3, 5 are defined by constant bending radii. However, it is to be noted that the first bent edge portion 3 is defined by a larger bending radius than the second curved edge portion 5.

In connection with the first rectilinear, lateral edge portion 7 there is indicated an area 11 of generally rectangular shape, said area 11 constituting a first joining area when a mug according to the present invention is formed from the blank 1 disclosed in FIG. 1. This first joining area 11 is facing the viewer in FIG. 1.

In connection with the second lateral edge portion 9 the triangularly shaped area 10 is provided, the base of the triangle is turned against the second curved edge portion 5 and the point of the triangle is turned against the first curved edge portion 3. This preferred design of the triangular portion 10 will be described in more detail below. The triangular portion 10 will be termed "the flap" below.

In connection with the second lateral edge portion 9 an area 12 with a generally rectangular shape is indicated, said area 12 constituting a second joining area when a mug according to the present invention is formed from the blank 1 disclosed in FIG. 1. This second joining area is facing away from the viewer in FIG. 1, this being indicated by the dashed illustration of the second joining area 12.

The blank 1 disclosed in FIG. 1 is waxed/plastic-coated on the side facing the viewer, whereas the side facing away from the viewer is not waxed/plastic-coated. The waxing/plastic-coating prevents this side to absorb the liquid that the mug holds. In this connection it should be emphasized that also the flap 10 has a waxed/plastic-coated and a non-waxed/non-plastic-coated side, and that the side facing the viewer in FIG. 2 is waxed.

Figure 2:
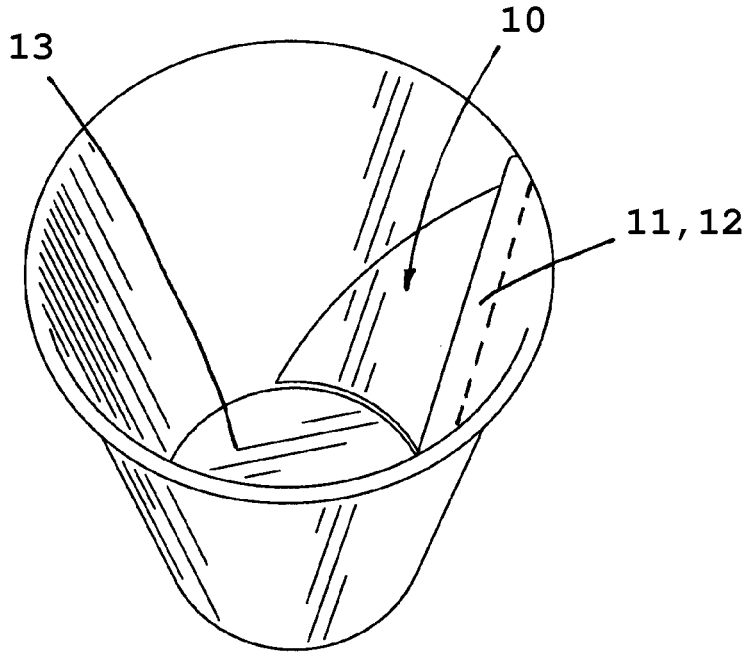
FIG. 2 shows a perspective view of a mug according to the present invention.

FIG. 2 shows a mug manufactured from blank disclosed in FIG. 1, where the two joining areas 11, 12 are overlapping each other. A suitable glue is applied to both these joining areas. Alternatively, glue can have been applied to these joining areas beforehand, and this glue can be activated, i.e. through heating. In this connection it should be noted that the flap 10 is loose against the inside of the mug, i.e. there is no attachment between the inside of the mug and the side of the flap 10 that faces the inside of the mug. The position of the flap 10 shown in FIG. 2 is representative of an initial, non-active position of the flap 10.

In addition to the blank shown in FIG. 1 the mug according to FIG. 2 also includes a circular bottom 13 that is connected with the blank in a conventional way. The upper rim of the mug is folded or rolled in a conventional way so that the user does not risk to cut himself by said rim.

Figure 3:
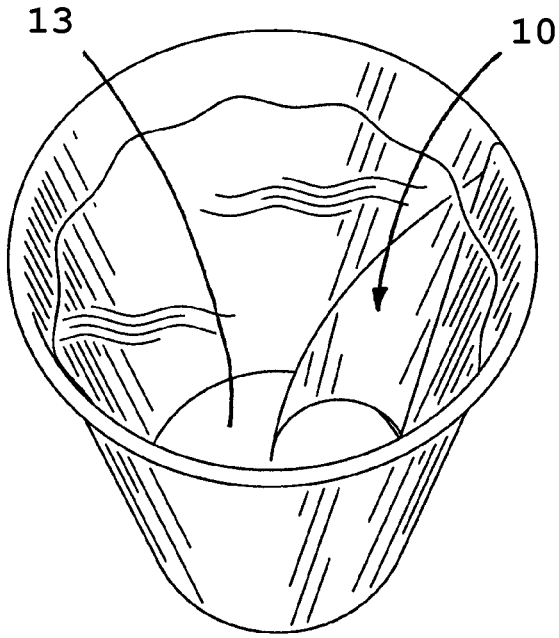
FIG. 3 shows a perspective view of the mug according to FIG. 2, when a liquid is poured into the mug.

FIG. 3 illustrates the behavior of the mug according to the present invention when it is filled with liquid, i.e. coffee and milk. The liquid is illustrated by a wavy line along the inside of the mug. As shown in FIG. 3, the flap 10 will assume a more curved shape than is the case in FIG. 2. The reason for this is that the side of the flap 10 that faces the inside of the mug is not waxed/plastic-coated and said side will absorb liquid, which makes the non-waxed/uncoated side to swell, i.e. the dimension of this side increases. This dimension increase results in that the flap 10 is given a further curvature compared to the design of the flap 10 according to FIG. 2. The flap 10 will generally have an extension towards the center of the mug, i.e. it reaches out from the inside of the mug. This represents an active position of the flap 10.

Figure 4:
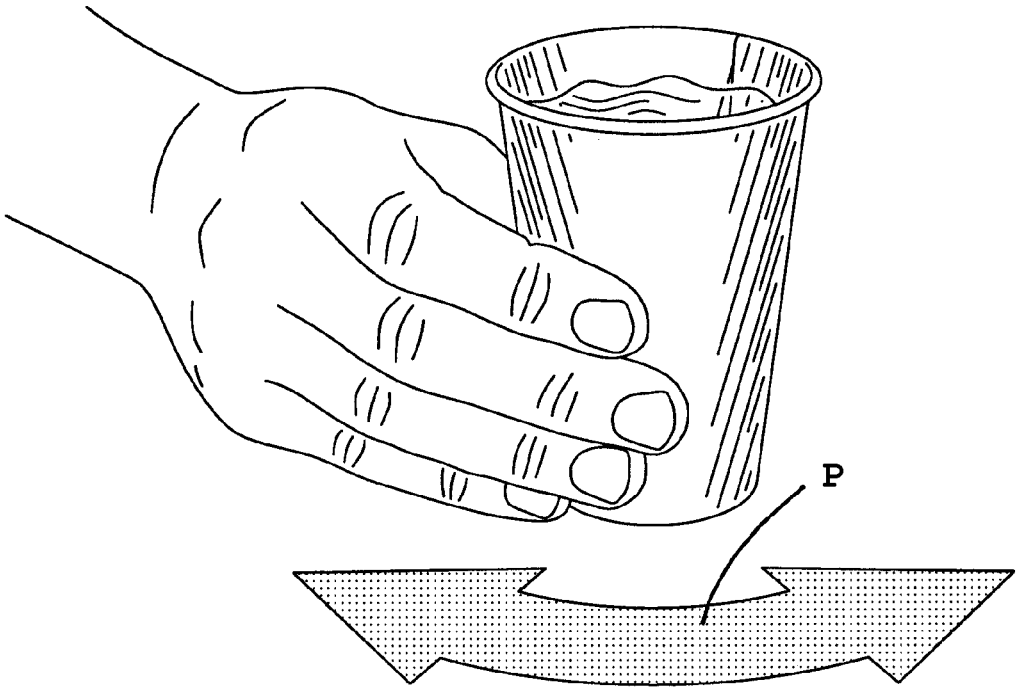
FIG. 4 shows a perspective view of a hand holding the mug with liquid, indicating how to handle the mug for achievement of the desired mixing effect.

If the mug according to the present invention is used for drinking coffee with milk, then normally the coffee is poured first into the mug. Thereafter a small amount of milk is added, which then normally sinks down to the bottom of the mug 13. By rotating the mug back and forth, see FIG. 4, in the directions shown by the double arrow P, the flap 10 now reaching out from the inside of the mug will take care of the mixing of coffee and milk. The drink is then ready to be consumed.

In this connection it should be pointed out that when the mug is rotated in the directions of the double arrow P the triangular shape of the flap 10 achieves the effect that the liquid is accelerated and retarded with different amounts at the bottom of the mug and higher up in the mug. This contributes to a good mixing of the two liquids in question, usually coffee and milk.

The triangular shape of flap 10 reduces the possibility that the flap 10 shall come in contact with the lips of the person drinking from the mug. If the flap is situated right in front of the mouth of the person drinking, the flap 10 will establish a chute for the liquid when it is emptied.

FEASIBLE MODIFICATIONS OF THE INVENTION

In the embodiment described above of the blank 1 it is said that the blank 1 is waxed or plastic-coated on one side. Naturally it is possible to treat said one side in some other way in order to prevent it from absorbing liquid.

In the embodiment described above, the triangular flap 10 is integral with the blank 1 in FIG. 1. Within the scope of the present invention, it is also feasible to design the triangular flap as a separate element that is applied to the inside of a conventional mug. In this case, the flap is glued or fastened in any other way to the inside of the mug in a separate operation, the shape and positioning of the flap 10 may in principle be the same as with an integrated flap.

In the above described design, the flap 10 is of a triangular shape. Within the scope of the present invention it is not necessary that the flap has a triangular shape. As a matter of fact, the flap can be of any suitable shape within the scope of the present invention. In FIG. 1 is shown with dotted lines, in an exemplifying and non-restricting purpose, an alternative shape of a flap 110 that has a generally rectangular shape in a plane view, i.e. when the blank is spread out.

Generally applies that the flap in non-activated state should have an extension along the inside of the mug, in the direction defined by the base of the triangle constituting the triangular flap 10, i.e. in connection with the bottom 13 of the mug. In its activated state, the flap will then reach towards the middle of the mug, so that the flap constitutes an effective means for mixing of coffee and milk when the mug is rotated in the direction shown by the double arrow P, see FIG. 4.

In the embodiment described above the flap 10; 110 has a side that is not waxed/plastic-coated, said side being intended to absorb the liquid in the mug. Within the scope of the present invention it is feasible that the flap is spring-activated/spring-loaded, i.e. that a leaf spring or the like in some way cooperates with the flap, the leaf spring either being integral with the flap or connected to the flap, e.g. by gluing or in another suitable way. When the mugs are stacked the flap is brought to contact the wall of the mug by another mug received in the first mug, said another mug urging the flap against the wall. Thereby the leaf spring is caused to be pre-stressed. When the received mug is removed the leaf spring will transfer the flap to a position bent outwards where the flap extends towards the centre of the mug. In such an embodiment it is not necessary that the flap has one liquid absorbing side and one non-absorbing side. Thus, the material of the flap could for instance be a plastic material.

The invention claimed is:

1. A mug that defines an internal space for receiving liquid, comprising:

a flap (10; 110) provided on an inside of the mug, the flap (10; 110) extending along the inside of the mug in a non-active state of the flap (10; 110), and the flap (10; 110) reaching out from the inside of the mug in an active state of the flap (10; 110), the flap (10; 110) having a first side that is impermeable to liquid and a second side that is permeable to liquid, the second side of the flap (10; 110) that is permeable to liquid facing towards the inside of the mug.

2. The mug according to claim 1, wherein the side of the flap (10; 110) that is impermeable to liquid is waxed/plastic-coated.

3. The mug according to claim 1, wherein the flap (10) is triangular, and that the base of the triangle faces a bottom (13) of the mug.

4. The mug according to claim 1, wherein the flap (110) is rectangular.

5. The mug according to claim 1, wherein the lower edge of the flap (10; 110) is located adjacent to a bottom (13) of the mug.

6. The mug according to claim 1, wherein the flap (10; 110) is integral with a blank (1) for the mug.

7. The mug according to claim 1, wherein the flap is spring-activated to resume a position where it reaches out from the inside of the mug.

8. The mug according to claim 2, wherein the flap (110) is rectangular.

* * * * *